United States Patent [19]

Paris

[11] Patent Number: 4,825,482

[45] Date of Patent: May 2, 1989

[54] MATTRESS SUPPORT ASSEMBLY

[75] Inventor: Roy Paris, Bethalto, Ill.

[73] Assignee: Welsh Co., St. Louis, Mo.

[21] Appl. No.: 126,870

[22] Filed: Nov. 30, 1987

[51] Int. Cl.[4] ..... A47C 31/00; A47D 7/00

[52] U.S. Cl. ..... 5/11; 5/93 R; 5/100; 5/207

[58] Field of Search ..... 5/11, 93 R, 100, 207, 5/208, 296, 297; 403/316

[56] References Cited

U.S. PATENT DOCUMENTS

| | | | |
|---|---|---|---|
| 746,852 | 12/1903 | Lein | 5/11 |
| 2,895,144 | 7/1959 | Feldman | 5/207 |
| 3,634,894 | 1/1972 | Harbison | 5/93 R X |
| 3,760,434 | 9/1973 | Neunherz et al. | 5/11 |
| 3,896,514 | 7/1975 | Feldstein | 5/11 X |

FOREIGN PATENT DOCUMENTS

| | | | |
|---|---|---|---|
| 438848 | 3/1912 | France | 5/296 |
| 672042 | 10/1964 | Italy | 5/100 |

*Primary Examiner*—Alexander Grosz
*Assistant Examiner*—Michael F. Trettel
*Attorney, Agent, or Firm*—Cohn, Powell & Hind

[57] ABSTRACT

This mattress hanger assembly provides an adjusting assembly for raising and lowering a mattress support. The assembly includes a bracket having a plurality of openings each representing a different position to which the support can be raised or lowered. A hanger carried by the support is received in one of these openings and a lock member secures the hanger in a selected opening to prevent the hanger from slipping out of the opening and placing the mattress in an unstable condition. The crib can include a drop rail having a track and slide system to facilitate access to the adjusting assembly.

18 Claims, 3 Drawing Sheets

MATTRESS SUPPORT ASSEMBLY

BACKGROUND OF THE INVENTION

This invention relates generally to children's cribs and more particularly to an improved hanger assembly for the crib mattress.

Children's cribs typically have respective head and foot panels, a fixed side rail and a side rail which can be raised or lowered commonly known as a drop rail. Further, many cribs have a mattress support or base which can be raised or lowered. A mattress rests on this support and by raising and lowering it, the crib can be used to accomodate children of varying sizes.

Previously, hooks attached to the ends of the mattress support were fitted into openings either formed in the bed posts or in a bracket attached to the bed posts. Problems occur when the hanger end slips out of the opening and causes the mattress support to suddendly drop at one end.

The present invention is an improvement over such prior cribs and solves these, and other problems in a manner not revealed by the known prior art.

SUMMARY OF THE INVENTION

This mattress support assembly provides a mattress support which can be adjusted to a number of different positions to accommodate children of different sizes and is particularly suitable for a growing child.

The adjusting means, which is provided at each corner of the mattress support, includes a lockable latching means so that the adjustment can be made at each corner in turn while the other corners remain secured.

The assembly provides that when the adjustment is properly made the weight of the child will not cause slippage.

It is an aspect of this invention to provide an adjustment means including bracket means having a plurality of vertically spaced openings each representing a different elevation to which the mattress can be adjusted; latch means carried by the mattress support to attach the mattress support to the bracket means; and lock means for securing the latch means in place to prevent the latch means from inadvertently slipping out of an opening and causing the mattress support to become unstable.

It is another aspect of this invention to provide that the bracket means includes a bracket attached to each corner post of the crib, each bracket having an associated latch hanger.

Yet another aspect of this invention is to provide that the lock means includes a spring mounted, manually operable lock member for each bracket opening, the spring being in the form of a loop spring.

Still another aspect of this invention is to provide that each bracket includes a rear plate and a face plate, the face plate having slots providing the spaced openings, the lock members selectively filling the upper end of said slots.

Another aspect of this invention is to provide that the lock members have a compatibly curved front face to facilitate removal of the hanger when the lock member is depressed and to facilitate snap replacement of the hanger.

Still another aspect of this invention is to provide a retaining shoulder on the lock member greater than the width of the slot and to provide a post on the underside of the lock member engageable with the loop spring.

It is yet another aspect of this invention to provide an adjusting means which is used in conjunction with a drop rail employing a track and slide system to facilitate access to the adjusting means.

It is an aspect of this invention to provide a mattress support adjusting means which is easy to use and relatively inexpensive to manufacture.

Other objects and features will be in part apparent and in part pointed out hereinafter.

BRIEF DESCRIPTION OF THE DRAWINGS

Corresponding reference characters designate corresponding parts throughout the several views of the drawings.

DESCRIPTION OF THE PREFERRED EMBODIMENT

Figure 1:
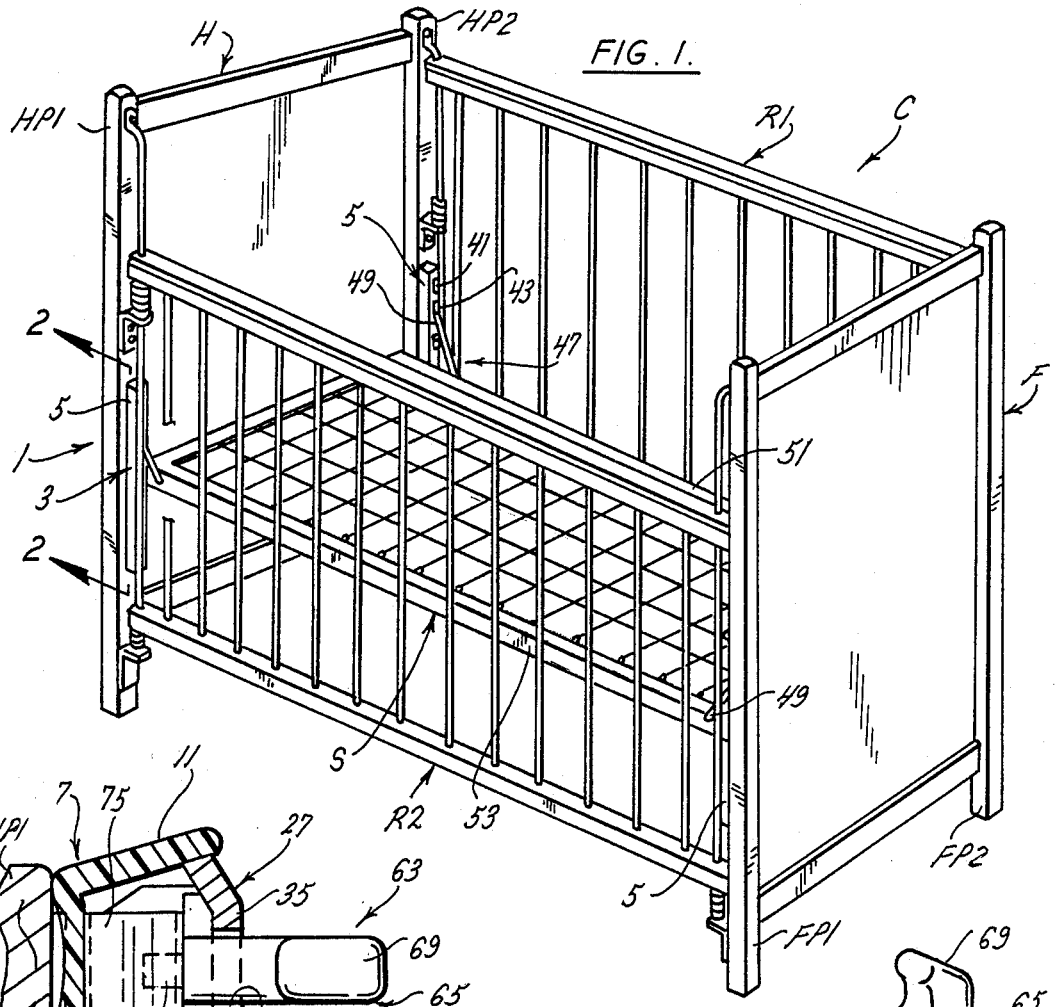
FIG. 1 is a perspective view of a child's crib having the improvement of the present invention.
Figure 6:
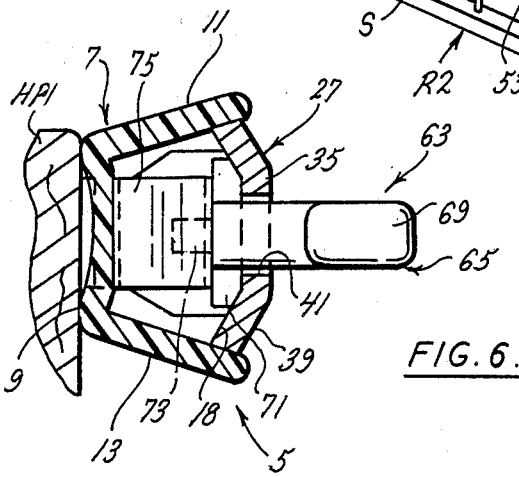
FIGS. 5 and 6 are sectional views respectively taken along lines 5—5 and 6—6 in FIG. 3.

Referring to the drawings, a child's crib C has a head panel H, a foot panel F, and side rails R1 and R2. Typically, one of the side rails, R1 for example, is fixed; while side rail R2, known as a drop rail, can be raised or lowered, as is well known in the art, to facilitate laying a child in the crib or picking the child up. The crib also has a mattress (not shown) which rests on a mattress spring or support S. As will be described hereinafter, support S can be raised or lowered—to raise or lower the height of the mattress—so the crib can be used for children of different sizes and particularly for a growing child.

An improvement to crib C is indicated generally by 1 and includes an adjusting means 3 for raising and lowering support S. Head panel H and foot panel F each have side posts (respectively identified as HP1 and HP2, and FP1 and FP2). Adjusting means 3 includes a bracket 5 mounted to the inner face of side posts HP1 and HP2 and to the inner face of side posts FP1 and FP2.

Because each bracket 5 is similar in construction, only one will be described in detail. Each bracket 5 has an elongate rear plate 7, formed from molded plastic in the preferred embodiment, with a concave base 9 and angled sidewalls 11 and 13; these sidewalls sloping outwardly. Tab ends 15 and 17 respectively form the upper and lower walls of the plate. Posts 19, 21 and 23 are respectively formed at the upper, middle and lower end of the plate, these posts upstanding from the inner face of the place base. Each post is bored to receive a mounting screw 25 by which the bracket is attached to a side post HP1, HP2, FP1 or FP2.

The bracket 5 further includes an elongate face plate 27 whose upper and lower ends are captured by the respective tabs 15 and 17 and which, when in place bears against shoulders 18, which space said face plate 27 from the concave base of the rear plate 7. Holes 29, 31 and 33 are drilled in the face plate, in registry with posts 19, 21 and 23, to accomodate the screws 25. The face plate 27 has a flat central section 35 and angled side portions 37 and 39. It will be understood that the general concave nature of the face plate 27 tends to provide a spring loaded effect in mounting the bracket 5 to the crib.

Slots are formed in the face plate, these slots being vertical slots and four such slots 41, 43, 44 and 45 being utilized in the drawings. These slots are used in adjusting the height of the mattress support and it will be understood that there could be more or less slots than shown for raising or lowering support S depending on the amount of elevational adjustment required.

Figure 3:
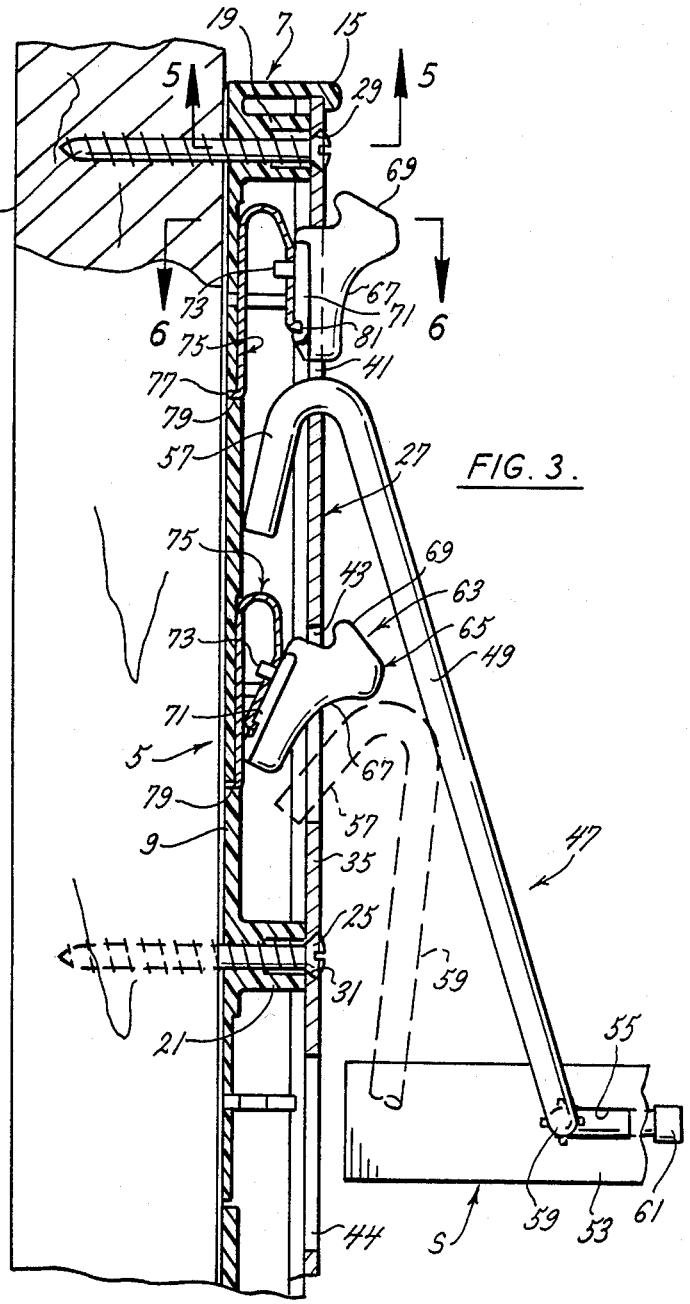
FIGS. 3 and 4 are sectional views respectively taken along lines 3—3 and 4—4 in FIG. 2.
Figure 4:
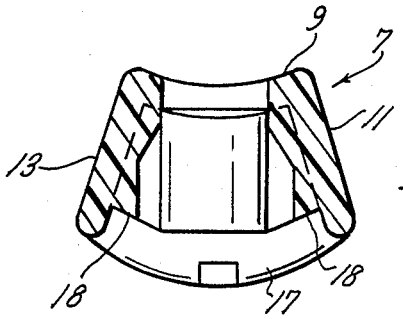

The adjusting means 3 next includes a latch means 47 which is carried by mattress support S and selectively receivable in the slots 41, 43, 44 or 45 to attach support S to the bracket 5. The latch means comprises hangers 49 attached to side frame members 51 and 53 forming a portion of the mattress supports. Four hangers 49 are used, one hanger being attached at each end of each side frame to provide corner attachment of the mattress support S to the crib C. A horizontal slot, such as the slot 55 as shown in FIG. 3, is formed in each side frame member at each end. Each hanger is formed from metal rod and has a hooked end 57 which fits in the slots 41, 43, 44 or 45 and an inwardly double turned end 59 which fits through slot 53. Suitable end caps 61 or other device are provided on this end of the hanger to keep it from being pulled out of slot 53, as is conventional.

The adjusting means also includes a lock means 63 which secures hanger 49 in a selected opening to prevent the latch means from inadvertently slipping out of the opening. This arrangement facilitates the adjustment of the corner of the mattress support in turn by a parent, for example, and also tends to prevent inadvertent slippage of a corner hanger when the child is returned to the crib. Lock means 63 includes a manually operable lock member 65, which is carried on bracket 5 and is movable to lock end 57 of a hanger 49 in a selected opening. The lock means 63 includes a lock member 65 for each opening in the bracket for the hanger.

Figure 7:
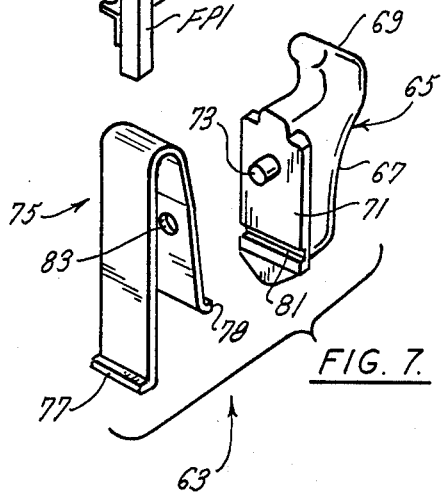
FIG. 7 is a perspective view of a lock.
Figure 5:
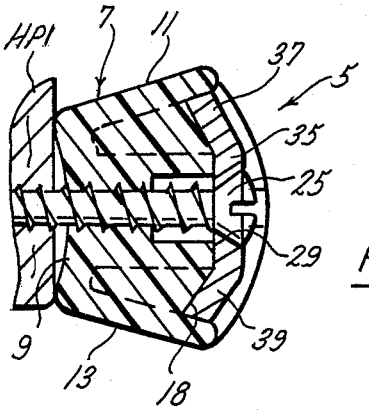
Figure 2:
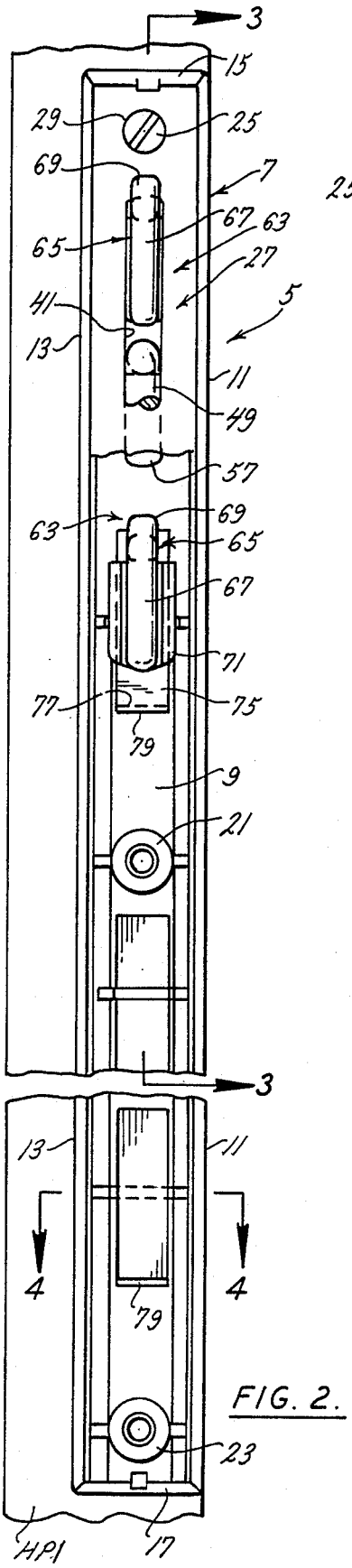
FIG. 2 is an elevational view of a bracket and latch assembly taken along line 2—2 of FIG. 1.

As best shown in FIG. 3 and FIG. 7 each lock member 65 has an outer curved surface portion 67 whose shape generally corresponds to, and is compatible with, the curvature of the hooked end 57 of hanger 49. Surface portion 67 flattens out at its upper end and has an upwardly, inwardly angled, flattened upper face 69 by which a person can manually move or flip the lock member using their thumb or finger. The lock member is mounted in bracket 5 with this outer curved surface protruding through the appropriate slot 41, 43, 44 and 45. The lock member is held in place, as will be described, so the surface portion 67 is located toward the upper end of the slot. The hook end 57 of hanger 49 bears against the lower end of the slot when the hanger is inserted in that respective slot.

Lock member 65 has a flattened shoulder or base section 71 whose width is greater than the width of the slot through which surface portion 67 extends. A post 73 projects outwardly from the underside of the base. Lock means 63 further includes a loop spring 75. Each end of the spring is turned outwardly to form lips 77 and 78. One lip fits in a transverse slot 79 formed in the inner face of base 9 of rear plate 7. The other lip fits in a transverse slot 81 formed in the underside of base section 71 of the lock member. In addition, an opening 83 is formed in the portion of the spring 75 adjacent the lock member and post 73 of the lock member fits in this opening. It will be understood that this arrangement holds the component parts of the lock means together within the bracket 5 without requiring additional fastening means once the bracket 5 is assembled and attached to the crib posts.

In use, when the position of support S is to be changed, i.e., the mattress height is to be raised or lowered, the hangers 49 are each adjusted in turn so their hook end fits in the appropriate bracket slot 41, 43, 44 or 45. In accomplishing this adjustment, the lock member 65 is manually rotated inwardly by pushing against the lock member face 69 against the action of the loop spring 75 so that the length of the slot is effectively increased to permit the hanger 49 to be lifted up and clear following which the pressure on the lock member can be released to return the lock member to its initial position. The hook member 49 can then be snapped into place in the next lower hole, as shown in phantom outline in FIG. 3 by engaging the hanger hook end 57 with the curved face 67 of said end, following which the lock member will automatically be returned to its locking position.

Figure 8:
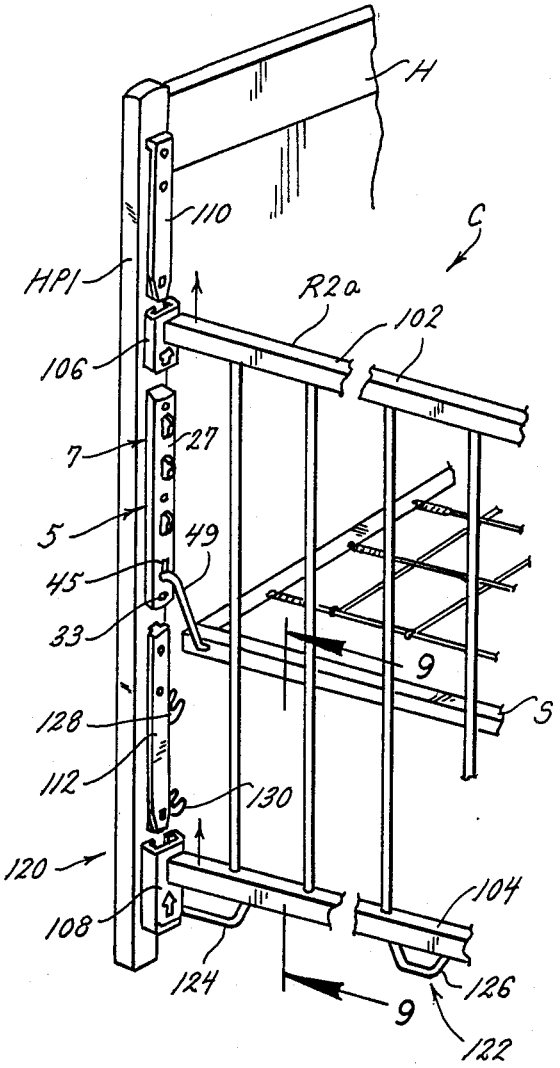
FIG. 8 is a framentary perspective view of a modified child's crib having the improvement of the present invention.

It will be understood that the adjusting means is shown in FIG. 1 in use with a crib of the type having a conventional drop rail. FIG. 8 discloses a modified crib having a track and slide system. The use of a track and slide system for the drop rail has the advantage that it facilitates access to the brackets 5 by eliminating the vertical slide member used in the conventional drop rail system. The brackets 5 themselves are as described above and are unchanged.

Figure 9:
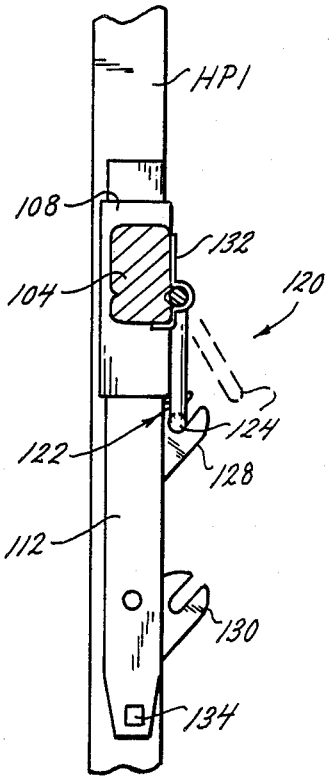
FIG. 9 is an enlarged sectional view taken on line 9—9 of FIG. 8.

The track and rail system generally indicated by numeral 100 is best understood by reference to FIGS. 8 and 9. It will be understood that the track and slide components are shown on the head panel front corner post HP1. The components for the foot panel FP1 front corner post are the same, but formed in mirror image where necessary.

As shown in FIG. 8 the drop rail R2*a* includes upper rail member 102 and a lower rail member 104 interconnected as by stringers. The upper rail member 102 includes a C-shaped slide member 106 at each end and the lower rail member includes a C-shaped slide 108 at each end said slides being fixedly attached. The posts HP1 and FP1 each includes a T-shaped upper track member 110 and a T-shaped lower track member 112, said track members being fixedly attached to said posts. The track members 110 and 112 receive the associated end slides 106 and 108 respectively in sliding relation. Because of the track and slide arrangement the drop rail R2*a* is movable yet provides ready access to the bracket 5.

The drop rail R2a is held in place in both the upper and lower positions by a trip system generally indicated by numeral 120. In the embodiment shown, this system includes an elongate trip rod 122 having cranked ends 124 and a U-shaped intermediate portion 126. The lower track members 112 include vertically spaced upper and lower retaining hook portions 128 and 130, respectively, which define the raised and lowered positions of the drop rail R2*a*. The retaining hook portions 128 and 130 selectively retain the ends of the trip rod 122 to hold said drop rail in place. As shown in FIG. 9 the trip rod 122 is rotatively mounted to the lower rail member 104, as by spaced brackets or clips 132 attached to said rail member and said trip rod can include a return spring (not shown). As shown in FIG. 8, the lower end of the track member 112 is provided with a spring loaded stop 134 which can be pushed into place and remove the slides 108.

When it is desired to raise the drop rail it is simply a matter of pushing in on the trip rod U-shaped intermediate portion 126 and lifting the drop rail up until the trip rod ends 124 cam passed the rounded lower faces of the upper retaining hook portions 128 to be received by said upper hook portions. When it is desired to lower the drop rail it is simply a matter of lifting up on the drop rail and pushing the trip rod U-shaped portion inwardly to clear the hook portions 128 and lowering the drop rail until the trip rod ends 124 are received by hook portions 130.

In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

I claim as my invention:

1. In a child's crib having respective head and foot panels, the panels each having a pair of side posts, a pair of side rails, and a movable mattress support, an improved adjusting means for raising and lowering the mattress support, the adjusting means comprising:

(a) bracket means including a bracket attached to each side post, each bracket having a plurality of vertically spaced openings therein, each opening representing a different position to which the mattress support can be raised or lowered;

(b) latch means carried by the mattress support and receivable in the openings to attach the mattress support to the bracket means the latch means including a hanger for each bracket, each hanger having one end secured to the mattress support and a hook shaped end adapted to be received in the openings of the associated bracket; and lock means resiliently attached to said bracket means for blocking the openings and adapted to secure the latch means in a selected opening to prevent the latch means from inadvertently slipping out of an opening and causing the mattress support to become unstable.

2. The improvement of claim 1, wherein:

(f) the lock means includes a manually operable lock member carried on the bracket and movable to lock the hook end of a hanger in a selected opening.

3. The improvement of claim 2, wherein:

(g) the lock means comprises a lock member for each opening in the bracket.

4. The improvement of claim 3, wherein:

(h) the lock means further includes a loop spring for each lock member.

5. The improvement of claim 1, wherein:

(d) the lock means includes a manually operable lock member for each opening in the bracket, said lock members being carried on the bracket and movable to lock the hook end of an associated hanger in a selected opening, and (e) each bracket comprises a rear plate and a face plate, each face plate having a plurality of longitudinal slots defining the spaced openings, the lock members extending through the upper end of each slot selectively filling said upper end of said slot and the lower end of each slot forming the opening in which the hook end of a hanger is received.

6. The improvement of claim 5, wherein:

(f) each lock means has a curved outer face whose curvature corresponds substantially to the curvature of the hook end of its associated hanger.

7. The improvement of claim 5, wherein:

(f) each lock means has a shoulder formed on its inner end, the width of the shoulder being wider than the width of the slot to retain the lock member in the slot.

8. The improvement of claim 5, wherein:

(f) the spring associated with each lock member is a loop spring, and (g) the underside of each lock member has a post extending outwardly therefrom and the associated loop spring for the lock member has an opening therein in which the post is received.

9. The improvement of claim 1, wherein:

(d) one of the side rails is a drop rail movable from a lower position to an upper position and said drop rail includes an upper rail member and an interconnected lower rail member, each member having a slide member at the end thereof, (e) one of the side posts of the head panel and one of the side posts of the foot panel is disposed adjacent the drop rail, each adjacent post including an upper track member disposed above the bracket and a lower track member disposed below said bracket, said upper track members receiving associated upper rail slide members, and said lower track members receiving said associated lower rail slide members in slidable relation to permit said drop member to be raised and lowered, and (f) trip means are provided between said drop rail and said adjacent side posts to selectively hold said drop rail in the upper position and the lower position.

10. (Amended) The improvement of claim 9, wherein:

(g) the trip means includes an elongate trip member carried by the drop rail lower member and having opposed ends and hook means on the lower track member selectively receiving said trip member associated end portions.

11. In a child's crib having respective head and foot panels, each panel having a pair of side posts, a pair of side rails, and a movable mattress support, an improved adjusting means for raising and lowering the mattress support, the adjusting means comprising:

(a) bracket means including a bracket attached to each side post, each bracket having a plurality of vertically spaced openings therein, each opening representing a different position to which the mattress support can be raised and lowered;

(b) latch means carried by the mattress support and receivable in the openings to attach the mattress support to the bracket means, the latch means including a hanger for each bracket, each hanger having one end secured to the mattress support and a hook shaped end adapted to be received in the openings of the associated bracket; and (c) lock means for securing the latch means in a selected opening to prevent the latch means from inadvertently slipping out of an opening and causing the mattress support to become unstable, the lock means including a manually operable lock member carried on the bracket and movable to lock the hook end of a hanger in a selected opening, the lock means further including a lock member for each opening in the bracket, each lock member including a loop spring.

12. The improvements of claim 11, wherein:

(d) the lock means includes a manually operable lock member for each opening in the bracket, said lock members being carried on the bracket and movable to lock the hook end of an associated hanger in a selected opening, and (e) each bracket comprises a rear plate and a face plate, each face plate having a plurality of longitudinal slots defining the spaced openings, the lock members extending through the upper end of each slot selectively filling said upper end of said slot and the lower end of each slot forming the opening in which the hook end of a hanger is received.

13. The improvements of claim 12, wherein:

(f) each lock member has a curved outer face whose curvature corresponds substantially to the curvature of the hook end of its associated hanger.

14. The improvements of claim 12, wherein:

(f) each lock member has a shoulder formed on its inner end, the width of the shoulder being wider than the width of the slot to retain the lock member in the slot.

15. The improvement of claim 12, wherein:

(f) the spring associated with each lock member is a loop spring, and (g) the underside of each lock member has a post extending outwardly therefrom and the associated loop spring for the lock member has an opening therein in which the post is received.

16. In a child's crib having respective head and foot panels, each panel having a pair of side posts, a pair of side rails, and a movable mattress support, an improved adjusting means for raising and lowering the mattress support, the adjusting means comprising:

(a) bracket means including a bracket attached to each side post, each bracket including a face plate having a plurality of longitudinal, vertical slots defining spaced openings, each opening representing a different position to which the mattress support can be raised or lowered;

(b) latch means carried by the mattress support and receivable in the openings to attach the mattress support to the brackets, the latch means including a hanger for each bracket each hanger having a hook shaped end receivable in its associated bracket's openings; and (c) lock means resiliently attached to said bracket means for blocking the openings and adapted to secure the latch means in a selected opening, the lock means comprising a lock member for each opening in each bracket, the lock members extending through the upper end of each slot selectively filling said upper end with the lower end of each slot forming the opening in which the hook end of a hanger is received.

17. In a child's crib having respective head and foot panels, each panel having a pair of side posts, a pair of side rails, and a movable mattress support, an improved adjusting means for raising and lowering the mattress support, the adjusting means comprising:

(a) bracket means including a bracket attached to each side post, each bracket having a plurality of vertically spaced openings therein, each opening representing a different position to which the mattress support can be raised and lowered:

(b) latch means carried by the mattress support and receivable in the openings to attach the mattress support to the bracket means, the latch means including a hanger for each bracket, each hanger having one end secured to the mattress support and a hook shaped end adapted to be received in the openings of the associated bracket; and (c) lock means for securing the latch means in a selected opening to prevent the latch means from inadvertently slipping out of an opening and causing the mattress support to become unstable, (d) the lock means includes a manually operable lock member for each opening in the bracket, said lock members being carried on the bracket and movable to lock the hook end of an associated hanger in a selected opening, and (e) each bracket comprises a rear plate and a face plate, each face plate having a plurality of longitudinal slots defining the spaced openings, the lock members extending through the upper end of each slot selectively filling said upper end of said slot and the lower end of each slot forming the opening in which the hook end of a hanger is received.

18. In a child's crib having respective head and foot panels, each panel having a pair of side posts, a pair of side rails, and a movable mattress support, an improved adjusting means for raising and lowering the mattress support, the adjusting means comprising:

(a) bracket means including a bracket attached to each side post, each bracket having a plurality of vertically spaced openings therein, each opening representing a different position to which the mattress support can be raised and lowered;

(b) latch means carried by the mattress support and receivable in the openings to attach the mattress support to the bracket means, the latch means including a hanger for each bracket, each hanger having one end secured to the mattress support and a hook shaped end adapted to be received in the openings of the associated bracket; and (c) lock means for securing the latch means in a selected opening to prevent the latch means from inadvertently slipping out of an opening and causing the mattress support to become unstable, (d) the lock means includes a manually operable lock member for each opening in the bracket, said lock members being carried on the bracket and movable to lock the hook end of an associated hanger in a selected opening, and (e) each bracket comprises a face plate, each face plate having a plurality of longitudinal slots defining the space of openings, the lock members extending through the upper end of each slot selectively filling said upper end of said slot and the lower end of each slot forming the opening in which the hook end of a hanger is received.

* * * * *

UNITED STATES PATENT AND TRADEMARK OFFICE

CERTIFICATE OF CORRECTION

PATENT NO. : 4,825,482

DATED : 5-2-89

INVENTOR(S) : Roy Paris

It is certified that error appears in the above-identified patent and that said Letters Patent is hereby corrected as shown below:

Column 1, line 20, delete "suddendly" and insert --suddenly--

Column 5, line 41, before "lock" insert--(c)--

Column 6, line 4, delete "means" and insert --member--

Column 6, line 8, delete "means" and insert--member--

Column 6, line 39, delete "(Amended)"

Signed and Sealed this

Ninth Day of January, 1990

*Attest:*

JEFFREY M. SAMUELS

*Attesting Officer*

*Acting Commissioner of Patents and Trademarks*